US006068458A

United States Patent [19]

Kikuchi

[11] Patent Number: 6,068,458

[45] Date of Patent: May 30, 2000

[54] SCROLL-TYPE FLUID DISPLACEMENT APPARATUS

[75] Inventor: Toshiyuki Kikuchi, Isesaki, Japan

[73] Assignee: Sanden Corporation, Gunma, Japan

[21] Appl. No.: 09/013,195

[22] Filed: Jan. 26, 1998

[30] Foreign Application Priority Data

Jan. 27, 1997 [JP] Japan ..... 9-12474

[51] Int. Cl.[7] ..... F01C 1/02

[52] U.S. Cl. ..... 418/55.4; 418/55.1; 418/194

[58] Field of Search ..... 418/55.4, 55.1, 418/194, 55

[56] References Cited

U.S. PATENT DOCUMENTS

| | | | |
|---|---|---|---|
| 2,728,300 | 12/1955 | Stoermer | 103/126 |
| 2,922,376 | 1/1960 | Hankel et al. | 103/120 |
| 3,132,869 | 5/1964 | Cambell | 277/171 |
| 3,490,383 | 1/1970 | Parrett | 103/130 |
| 4,456,435 | 6/1984 | Hiraga et al. | 417/302 |
| 4,460,321 | 7/1984 | Terauchi | 418/55 |
| 4,477,238 | 10/1984 | Terauchi | 418/55 |
| 4,571,163 | 2/1986 | Sakamoto | 418/55 |
| 4,892,469 | 1/1990 | McCullough et al. | 418/55 |
| 4,913,635 | 4/1990 | Ochiai et al. | 418/55 |
| 5,505,595 | 4/1996 | Fukui | 418/55.1 |
| 5,580,228 | 12/1996 | Ishikawa | 418/55.4 |
| 5,641,278 | 6/1997 | Tsumagari | 418/55.1 |
| 5,660,538 | 8/1997 | Higashiyama et al. | 418/55.4 |

FOREIGN PATENT DOCUMENTS

| | | | |
|---|---|---|---|
| 0075053 | 3/1983 | European Pat. Off. . | |
| 0 240 739 | 10/1987 | European Pat. Off. | 418/55.4 |
| 08061279 | 3/1996 | European Pat. Off. . | |
| 0039623 | 11/1981 | WIPO . | |
| 8203429 | 10/1982 | WIPO . | |

*Primary Examiner*—Thomas Denion
*Assistant Examiner*—Thai-Ba Trieu
*Attorney, Agent, or Firm*—Baker Botts, L.L.P.

[57] ABSTRACT

A scroll-type fluid displacement apparatus comprises a housing having an inlet port and outlet port and a fluid displacement mechanism having a first end and a second end disposed within the housing for displacing a fluid from the inlet port to the outlet port. The fluid displacement mechanism is fixed to the housing by a plurality of fixing members. A discharge chamber is defined by the first end of the displacement mechanism and the housing. A matching surface is defined between the first end of the fluid displacement mechanism and the inner surface of the housing. A sealing device is disposed in the matching surface for sealing the matching surface between adjacent fixing members. Thereby, the scroll-type fluid displacement apparatus has superior axial sealing of the discharge chamber while simultaneously achieving simplifying manufacturing.

15 Claims, 4 Drawing Sheets

SCROLL-TYPE FLUID DISPLACEMENT APPARATUS

BACKGROUND OF THE INVENTION

1. Field of the Invention

The present invention relates to scroll-type fluid displacement apparatus. More particularly, the present invention relates to a sealing mechanism of a scroll-type refrigerant compressor used in an automotive air conditioning system.

2. Description of the Related Art

A sealing mechanism of a discharge chamber defined between a housing and a scroll member used in a scroll-type fluid displacement apparatus is known in the art and is described in U.S. Pat. No. 5,336,058. Thus, the scroll-type fluid displacement apparatus includes a housing having an inlet port and outlet port and a fluid displacement mechanism within the housing for displacing a fluid from the inlet port to the outlet port. The fluid displacement mechanism is fixed to the housing by a plurality of fixing bolts. A discharge chamber is defined by the displacement mechanism and the housing, such that an O-ring seals the matching surface between displacement mechanism and the housing.

Further, FIGS. 1 and 2 depict a sealing mechanism of a discharge chamber defined between a housing and a scroll member used in a scroll-type refrigerant compressor without using an O-ring seal, as in an earlier technology. A housing 1 is formed of a cup-shaped casing 2 and a funnel-shaped front end plate 3 which closes the open end of casing 2. Casing 2 is provided with a fluid inlet port (not shown) for introducing fluid into housing 1, and a fluid outlet port 210 for discharging the fluid from housing 1. A fixed scroll member 10 has a first plate 11 of a substantially circular shape and a first spiral element 12 formed on a first face of first plate 11. Fixed scroll member 10 also has female threaded openings 16 which engage bolts 5 inserted through apertures 6 from outside of housing 1. Thereby, fixed scroll member 10 is formed between first plate 11 and the inner surface of casing 2. A discharge chamber 17 is in communication with a discharge port 13 and fluid outlet port 210.

An orbiting scroll member 20 has a second plate 21 of a substantially circular shape and a second spiral element 22 formed on a first face of second plate 21. Orbiting scroll member 20 is assembled with fixed scroll member 10, so that second spiral element 22 engages first spiral element 12 with a phase deviation of 180 degrees. This engagement forms a plurality of sealed off fluid pockets 23 between fixed scroll member 10 and orbiting scroll member 20. Second plate 21 is provided at its second face with a boss 24. A bushing 26 is disposed inside boss 24 with a needle bearing 25 therebetween. Bushing 26 has an eccentric aperture 26*a* and a pin 26*b*. Bushing 26 also is provided with counter weight 27 for canceling centrifugal force created by orbiting scroll member 20. A rotation preventing thrust bearing mechanism 28 is disposed between second plate 21 and front end plate 3 and prevents the rotation of orbiting scroll member 20 on its axis during revolution of front end plate 3 along a substantially circular path. Fixed scroll member 10 and orbiting scroll member 20 are assembled together to form a space, i.e., a suction chamber 29, between the inner peripheral surface of casing 2 and the outer peripheral surface of fixed scroll member 10 and orbiting scroll member 20. Suction chamber 29 is in communication with the fluid inlet port (not shown). Further, a plurality of reed valve members 40 cooperate with discharge port 13 at rear end surface of first plate 11. Reed valve members 40 control the opening and closing of discharge port 13 in response to a pressure differential between first discharge chamber 17 and a central pocket of fluid pocket 23. A retainer 41 is provided to prevent excessive bending reed valve member 40 when discharge port 13 is opened. An end of each of reed valve members 40 is fixedly secured to first plate 11 of fixed scroll 10 by a single bolt 43, together with one end of retainer 41.

A drive shaft 31 has a small diameter portion 31*a* and a large diameter portion 32 provided at opposite portions. Small diameter portion 31*a* is rotatably supported by a ball bearing 33 disposed inside one end of front end plate 3. Large diameter portion 32 is rotatable supported by a ball bearing 34 also disposed inside one end of front end plate 3, and large diameter portion 32 is provided at an eccentric position with a crank pin 35, which is inserted into eccentric aperture 26*a* in bushing 26.

Thereby, drive shaft 31 and orbiting scroll member 20 are connected, so that the orbiting scroll moves orbitally in accordance with the rotation of drive shaft 31. Large diameter portion 32 also is provided with arc-shaped grooves 36 for receiving pin 26*b* of bushing 26. The arc of grooves 36 has a center coincident with the center line of crank pin 35. Due to the engagement of one of grooves 36 by pin 26*b*, the rotation of bushing 26 around crank pin 35 is restricted. Counter-weight 27 for canceling centrifugal force created by orbiting scroll member 20 is thereby attached to drive shaft 31. The end of drive shaft 31 is connected to an electromagnetic clutch 38 mounted on the outer end of plate 3.

Casing 2 includes an annular sealing surface 2*a* formed inside of casing 2 and an annular rib 14 formed at the rear end of casing 2. Annular rib 14 is provided with a plurality of projecting portions 14*a* projecting toward the longitudinal axis of the compressor. Each projecting portion 14*a* of annular rib 14 has respectively aperture 6 formed therein, which is penetrated by bolt 5. Annular rib 14 has a sealing surface 14*b* facing toward a rear end surface 11 a of first plate 11 of fixed scroll member 10 and is inclined to sealing surface 2*a* of casing 2 at a 90 degree angle. Consequently, the matching surfaces between annular sealing surface 2*a* of casing 2 and side surface 11*b* of first plate 11 of fixed scroll 10 are sealed in surface contact by forcible insertion. Further, the matching surfaces between rear end surface 11*a* of first plate 11 of fixed scroll member 10 and sealing surface 14*b* of annular rib 14 are sealed in surface contact.

In this arrangement, the matching surfaces between rear end surface 11*a* of first plate 11 of fixed scroll member 10 and sealing surface 14*b* of annular rib 14 are sealed in surface contact. In particular, the matching surfaces are tightly sealed at around bolts 5, i.e., a first area "α," shown by hatching, because bolts 5 firmly engage fixed scroll member 10 through aperture 6 of annular rib 14 of casing 2. Referring to FIG. 2, an axial gap created between rear end surface 1 a of first plate 11 of fixed scroll member 10 and sealing surface 14*b* of annular rib 14 increases at points distant from bolts 5 because the tight force, which bolts 5 exert to tighten rear end surface 11*a* of first plate 11 of fixed scroll member 10 to sealing surface 14*b* of annular rib 14, decreases at points distant from bolts 5. Thereby, a small gap is created at a second area "β," which is between adjacent bolts 5 on rear end surface 11*a* of first plate 11 of fixed scroll member 10 and sealing surface 14*b* of annular rib 14. As a result, discharge gas in discharge chamber 17 tends to leak from this gap.

SUMMARY OF THE INVENTION

It is an object of the present invention to provide a scroll-type fluid displacement apparatus which has superior axial sealing of the discharge chamber.

It is another object of the present invention to provide a scroll-type fluid displacement apparatus which may be simply manufactured.

According to the present invention, a scroll-type fluid displacement apparatus comprises a housing having an inlet port and outlet port and a fluid displacement mechanism having a first end and a second end disposed within the housing for displacing a fluid from the inlet port to the outlet port. The fluid displacement mechanism is fixed to the housing by a plurality of fixing members. A discharge chamber is defined by the first end of the displacement mechanism and the housing. A driving mechanism is disposed in the housing and is operatively connected to the fluid displacement mechanism. A matching surface is defined between the first end of the fluid displacement mechanism and the inner surface of the housing. A sealing device is disposed in the matching surface for sealing the matching surface between adjacent fixing members.

Further objects, features and advantages of this invention will be understood from the following detailed description of preferred embodiments with reference to the attached drawings.

DETAILED DESCRIPTION OF PREFERRED EMBODIMENTS

Figure 1:
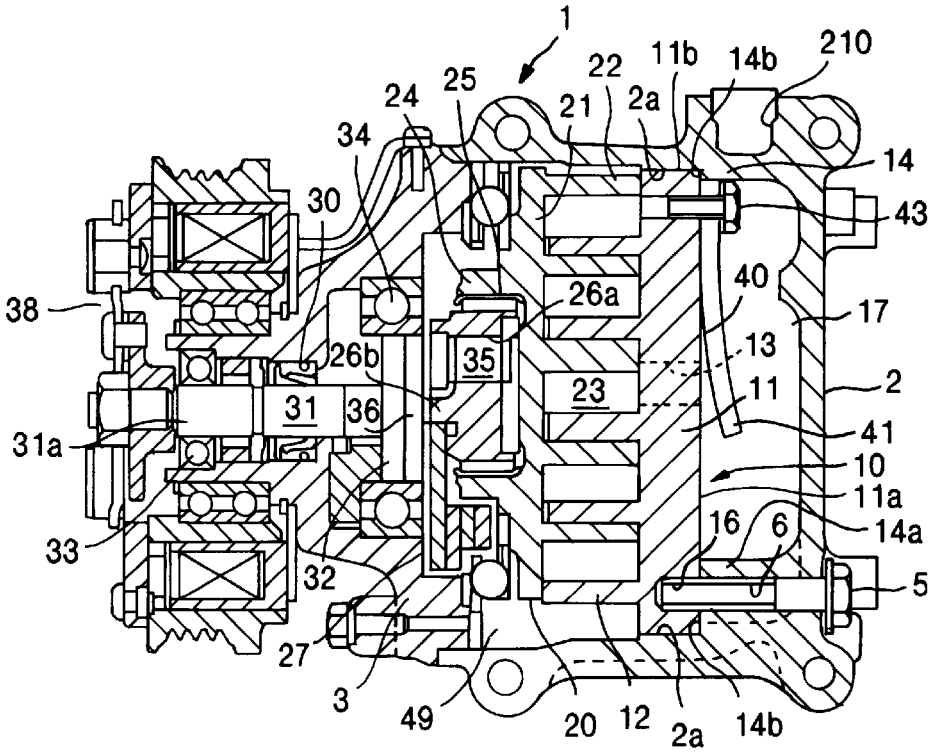
FIG. 1 PRIOR ART
FIG. 1 is a longitudinal, cross-sectional view of a scroll-type refrigerant compressor in accordance with a prior art.
Figure 2:
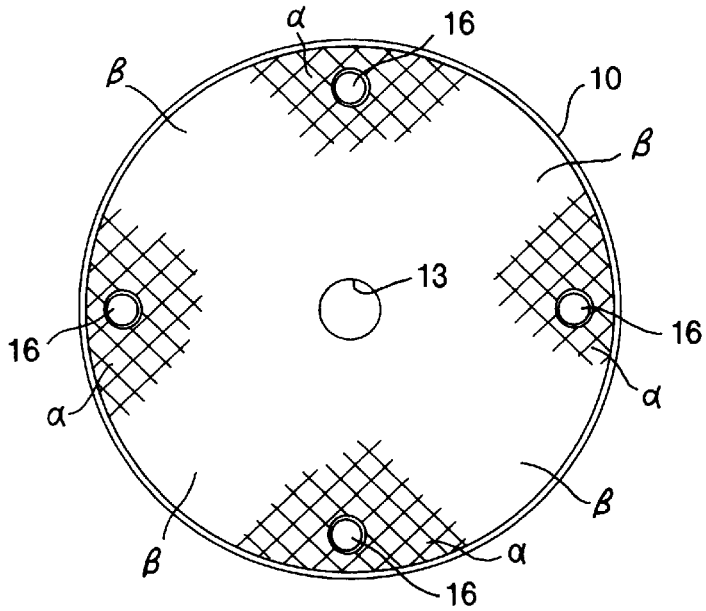
FIG. 2 PRIOR ART
FIG. 2 is a rear view of a fixed scroll of the scroll-type refrigerant compressor in accordance with the prior art.
Figure 3:
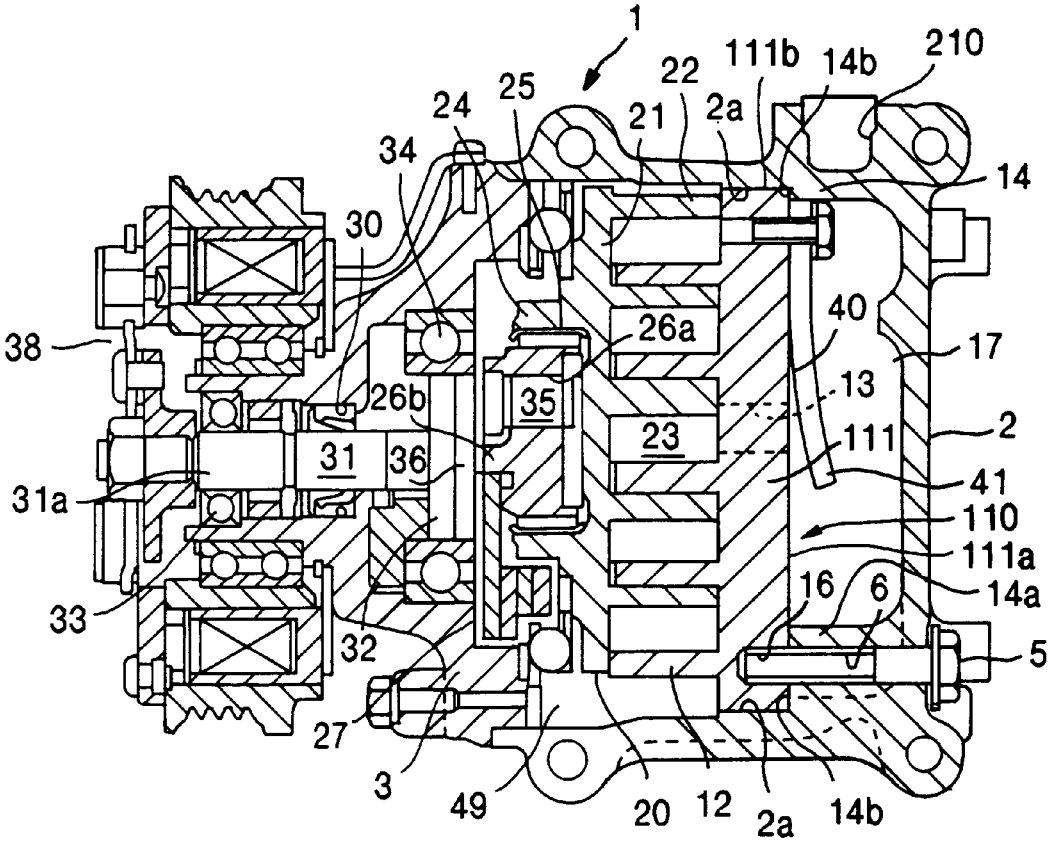
FIG. 3 is a longitudinal, cross-sectional view of a scroll-type refrigerant compressor in accordance with an embodiment of a present invention.
Figure 4:
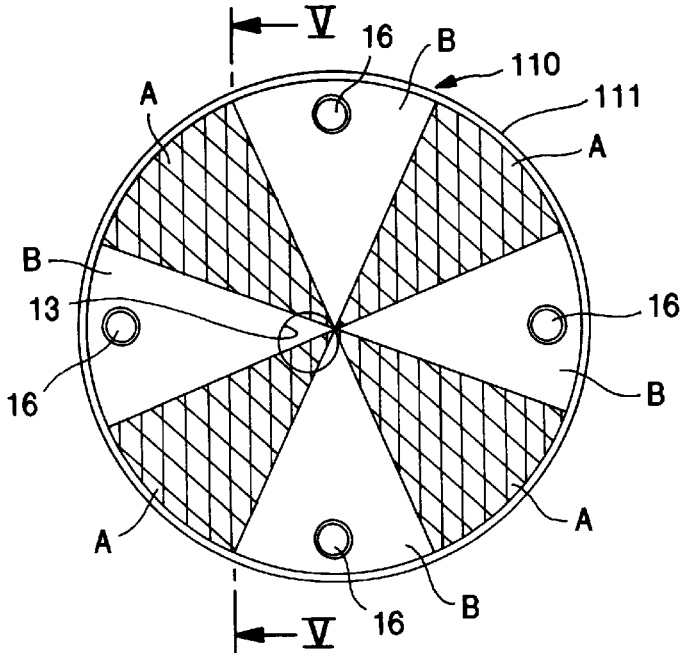
FIG. 4 is a rear view of the fixed scroll of the scroll-type refrigerant compressor in accordance with the embodiment of a present invention.
Figure 5:
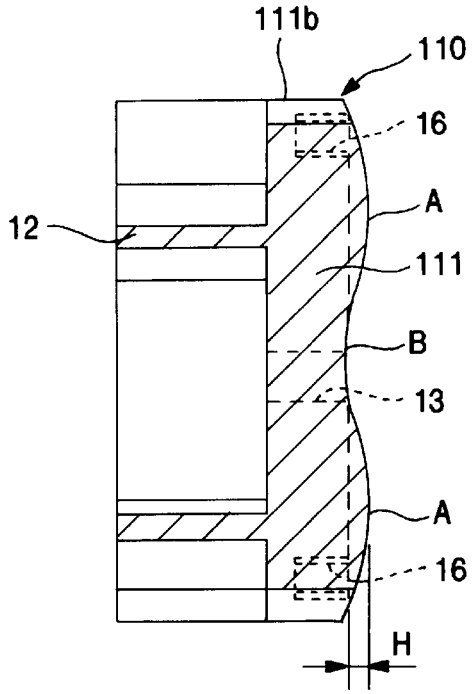
FIG. 5 is across-sectional view of the fixed scroll of the scroll-type refrigerant compressor taken along line V—V of FIG. 4.

The embodiment of the present invention is illustrated in FIGS. 3, 4 and 5 in which the same numerals are used to denote elements which correspond to similar elements depicted in FIG. 1 of the prior art. A detailed explanation of several elements and characteristics of the prior art compressor is provided above and, therefore, is here omitted.

Referring to FIG. 3, a fixed scroll member 110 has a first plate 111 of a substantially circular shape and a first spiral element 12 formed on a first face of first plate 111. The matching surfaces between inner surface 2*a* of casing 2 and a side surface 111*b* of first plate 111 of fixed scroll 110 are sealed in surface contact by forcible insertion. Further, the matching surfaces between rear end surface 111*a* of first plate 111 of fixed scroll member 110 and sealing surface 14*b* of annular rib 14 are sealed in surface contact. Fixed scroll member 110 also has female threaded openings 16 which engages bolts 5 inserted through apertures 6 from outside of housing 1. Thus, discharge chamber 17 is formed between first plate 111 of fixed scroll member 110 and the inner surface of casing 2. Discharge chamber 17 is in communication with discharge port 13 and a fluid outlet port 210.

Referring to FIG. 4, rear end surface 111*a* has a first sealing area A, which is formed between adjacent openings 16, and a second sealing area B, which is formed to surround openings 16 and is contiguous to first sealing area A. In other words, first sealing area A and second sealing area B are respectively fan-shaped extending from the radial center of first plate 11 of fixed scroll member 110. First sealing area A and second sealing area B are a convex surface and a concave surface in cross-section, respectively, in contrast to that of the prior art. Further, rear end surface 111*a* of first plate 111 has a varying height, which increases to a maximum at the middle portion of first sealing area A and decreases as it approaches the middle portion of second sealing area B. Then, differential "H" between an axial maximum height of first sealing area A and an axial minimum height of second sealing area B is preferably designed to be about 1 to about 20 $\mu$m. Thus, openings 16 are formed with in the range of second sealing area B.

In this configuration, when fixed scroll member 110 is secured to casing 2 by bolts 5, the matching surface between rear end surface 111*a* of first plate 111 and sealing surface 14*b* of rib 14 of casing 2 is sealed in surface contact. Subsequently, second sealing surface B is tightened toward sealing surface 14*b* of rib 14 because bolt 5 is screwed in opening 16 of first plate 111 of fixed scroll 110.

Consequently, first sealing area A becomes substantially equivalent to second sealing area B in an axial thickness. In particular, both first sealing area A and second sealing area B are transformed into a flat sealing surface. As a result, the matching surface between rear end surface 111*a* of first plate 111 and sealing surface 14*b* of annular rib 14 of casing 2 are closely sealed to each other.

When rear end surface 111*a* of first plate 111 is manufactured so as to include first sealing area A and second sealing area B, rear end surface 111*a* of first plate 111 may be produced by lathe machining so as to acquire a wave-like form thereon. By the progress of the chuck of lathe machine, the wave-like form formed on rear end surface 111*a* of first plate 111 corresponding to a number of clicks, i.e., adjustments, of the chuck because the initial deformation and cutting resistance are caused by the chuck of lathe machine. A chuck pressure and cutting resistance control the dimensions of the wave-like form of rear end surface 111*a* of first plate 111. Therefore, the chuck of lathe machine may be set, such that a number of clicks are identical to that of bolts 5. Further, rear end surface 111*a* of first plate 111 may be produced by other suitable process, such as cutting process, other than on a lathe machine so as to acquire the wave-like form thereon.

Figure 6:
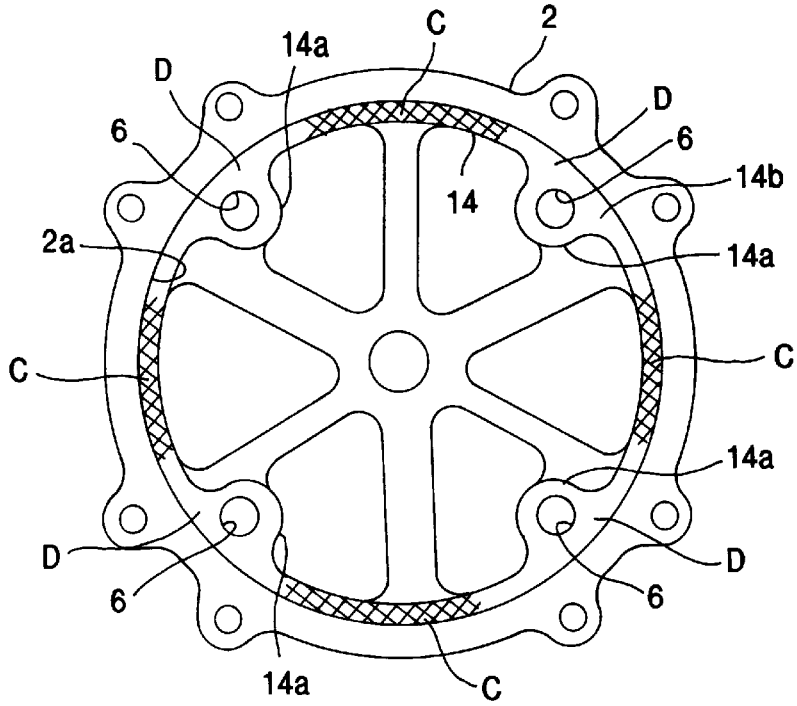
FIG. 6 is a front view of a housing of the scroll-type refrigerant compressor in accordance with a second embodiment of a present invention.

FIG. 6 illustrates a second embodiment of the present invention. Elements in FIG. 6 similar to those in FIG. 3 are designated with the same reference numerals.

Rear end surface 111*a* of first plate 111 is designed to be a flat surface different from the first embodiment. Sealing surface 14*b* of annular rib 14 of casing 2 has a first sealing area C (shown by hatching) formed between adjacent openings 6 and a second sealing area D formed so as to surround openings 6 other than at first sealing area C. Each of second sealing areas D is contiguous to first sealing area C. First and second sealing area C and D are a convex surface and a concave surface in cross section, respectively, in contrast to that of the prior art.

In other words, each of first and second sealing areas C and D are fan-shaped at the radial center of first plate 111 of fixed scroll member 110. Openings 6 are located within the range of second sealing area D. Further, sealing surface 14*b* of annular rib 14 of casing 2 has a height, which is greatest at the middle portion first sealing area C and decreases as it approaches the middle portion of second sealing area D.

Figure 7:
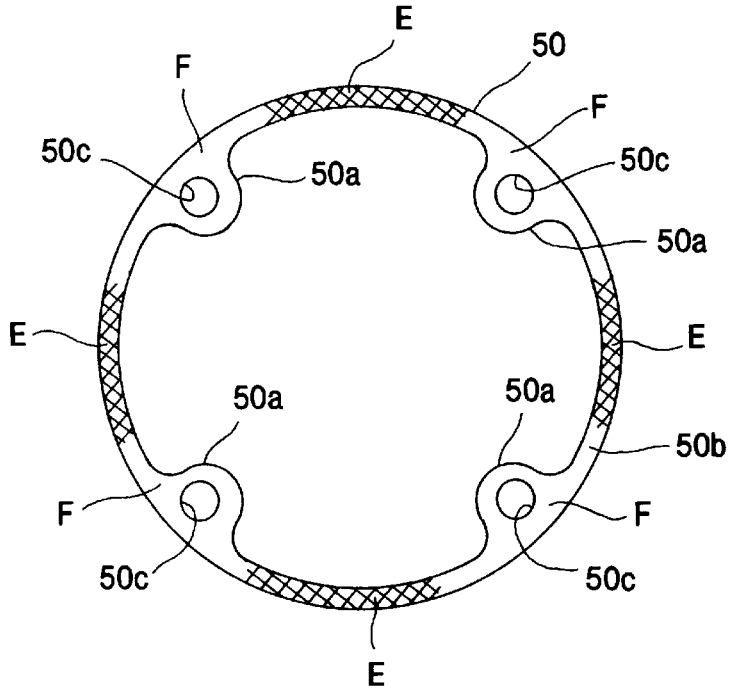
FIG. 7 is a front view of a gasket used in the scroll-type refrigerant compressor in accordance with a third embodiment of a present invention.

FIG. 7 illustrates a third embodiment of the present invention. Elements in FIG. 7 similar to those in FIG. 3 are designated with the same reference numerals. However, rear end surface 111*a* of first plate 111 and sealing surface 14*b* of annular rib 14 of casing 2 are designed to be flat surfaces different from the first embodiment.

A gasket 50 is disposed between rear end surface 111*a* of first plate 111 and sealing surface 14*b* of annular rib 14 of casing 2 so as to have a shape corresponding to the matching surface formed between rear end surface 111*a* of first plate 111 and sealing surface 14*b* of annular rib 14 of casing 2. Annular rib 14 is provided with a plurality of projecting portions 14*a* projecting toward the longitudinal axis of the compressor. Each projecting portion 14*a* of annular rib 14 has respectively opening 6, therein, which is penetrated by bolt 5. Gasket 50 is provided with a plurality of projecting portions 50*a* corresponding in number to openings 6 of projections 14*a* of ribs 14. The plurality of projecting portions 50*a* extend toward the radial center of gasket 50. Each projecting portion 50*a* has an aperture 50*c* formed therein, which is penetrated by bolt 5. At least one side surface 50*b* of gasket 50 has a first sealing area E (shown by hatching) formed between adjacent openings 50*c* and a second sealing area F formed to surround openings 50*c*. Moreover, gasket 50 has a thickness, which is greatest around the middle portion of first sealing area E and decreases as it approaches the middle portion of second sealing area F. Each of second sealing area F is contiguous to adjacent first sealing area E formed on gasket 50. Thus, openings 50*c* are formed in the range of second sealing area F.

Substantially the same advantages as those achieved in the first embodiment are realized in the third embodiment.

Although the present invention has been described in connection with preferred embodiments, the invention is not limited thereto. It will be understood by those of ordinary skill in art that variations and modifications may be readily made within the scope of this invention as defined by the appended claims.

What is claimed is:

1. A scroll-type fluid displacement apparatus comprising:

housing having an inlet port and outlet port;

a fluid displacement mechanism having a first end and a second end disposed within said housing for displacing a fluid from said inlet port to said outlet port, said fluid displacement mechanism fixed to said housing by a plurality of fixing devices;

a discharge chamber defined by said first end of said displacement mechanism and said housing;

a driving mechanism disposed in said housing and operatively connected to said fluid displacement mechanism;

a matching surface defined between said first end of said fluid displacement mechanism and an inner surface of said housing; and sealing means disposed in said matching surface for sealing said matching surface, between said adjacent fixing means, wherein said sealing means comprises at least one raised portion.

2. The scroll-type fluid displacement apparatus of claim 1, wherein said sealing means includes a surface portion formed on said first end of said fluid displacement mechanism.

3. The scroll-type fluid displacement apparatus of claim 1, wherein said plurality of fixing devices are bolts.

4. The scroll-type fluid displacement apparatus of claim 1, wherein said sealing means includes a surface portion formed on said inner surface of said housing.

5. The scroll-type fluid displacement apparatus of claim 4, wherein said surface portion of said inner surface of said housing includes a plurality of openings formed therein for receiving said fixing device.

6. The scroll-type fluid displacement apparatus of claim 5, wherein a plurality of said openings, are formed at equal angular intervals from a radial center of said housing.

7. The scroll-type fluid displacement apparatus of claim 1, wherein said fluid displacement mechanism includes a fixed scroll fixedly disposed within said housing and having a circular end plate from which a first spiral element extends into an interior of said housing and an orbiting scroll having a circular end plate, a second spiral element extending from a first surface of said a circular end plate, whereby said first and second spiral elements interfit at an angular and radial offset to form a plurality of line contacts defining at least a pair of fluid pockets within said interior of said housing, said orbiting scroll having a first and a second grooves formed on a second surface of said circular end plate, which grooves are diametrically opposed to each other.

8. A scroll-type fluid displacement apparatus comprising:

housing having an inlet port and outlet port;

a fluid displacement mechanism having a first end and a second end disposed within said housing for displacing a fluid from said inlet port to said outlet port, said fluid displacement mechanism fixed to said housing by a plurality of fixing means;

a discharge chamber defined by said first end of said displacement mechanism and said housing;

a driving mechanism disposed in said housing and operatively connected to said fluid displacement mechanism;

a matching surface defined between said first end of said fluid displacement mechanism and an inner surface of said housing; and sealing means disposed in said matching surface for sealing said matching surface, between said adjacent fixing means, wherein said sealing means includes a surface portion formed on said first end of said fluid displacement mechanism, wherein said surface portion includes a plurality of convex surfaces and a plurality of concave surfaces mutually contiguous with said convex surfaces and wherein said fixing means are received in said concave surfaces.

9. The scroll-type fluid displacement apparatus of claim 8, wherein each of said convex surfaces and concave surfaces is fan-shaped extending from the radial center of said first end of said fluid displacement mechanism.

10. The scroll-type fluid displacement apparatus of claim 3, wherein said surface portion of said first end of said fluid displacement mechanism includes a plurality of openings formed thereon for receiving said fixing means.

11. The scroll-type fluid displacement apparatus of claim 10, wherein a plurality, of openings are formed at equal angular intervals from a radial center of first end of said fluid displacement mechanism.

12. A scroll-type fluid displacement apparatus comprising:

housing having an inlet port and outlet port;

a fluid displacement mechanism having a first end and a second end disposed within said housing for displacing a fluid from said inlet port to said outlet port, said fluid displacement mechanism fixed to said housing by a plurality of fixing means;

a discharge chamber defined by said first end of said displacement mechanism and said housing;

a driving mechanism disposed in said housing and operatively connected to said fluid displacement mechanism;

a matching surface defined between said first end of said fluid displacement mechanism and an inner surface of said housing; and sealing means disposed in said matching surface for sealing said matching surface, between said adjacent fixing means, wherein said sealing means is a gasket member.

13. The scroll-type fluid displacement apparatus of claim 12, wherein said gasket member includes a gasket surface portion formed thereon and having a plurality of convex surfaces and a plurality of concave surfaces contiguous with said convex surfaces and wherein said fixing means are received in said concave surfaces.

14. The scroll-type fluid displacement apparatus of claim 13, wherein said surface portion of said gasket member includes a plurality of openings formed thereon for receiving said fixing means.

15. The scroll-type fluid displacement apparatus of claim 14, wherein a plurality of said openings are formed at equal angular intervals from a radial center of said gasket member.

* * * * *